US006308853B1

(12) United States Patent
Jud

(10) Patent No.: US 6,308,853 B1
(45) Date of Patent: Oct. 30, 2001

(54) LID MATERIAL

(75) Inventor: Wilfried Jud, Singen (DE)

(73) Assignee: Alusuisse Technology & Management, Ltd., Neuhausen am Rheinfall ( * ) Notice: Subject to any disclaimer, the term of this patent is extended or adjusted under 35 U.S.C. 154(b) by 0 days.

(21) Appl. No.: 09/379,490

(22) Filed: Aug. 23, 1999

(30) Foreign Application Priority Data

Sep. 1, 1998 (EP) ..... 98810866

(51) Int. Cl.[7] ..... B65D 41/00

(52) U.S. Cl. ..... 220/359.3; 156/277; 215/230; 215/232; 220/380

(58) Field of Search ..... 40/310, 311, 324; 283/93; 215/230, 232; 220/359.1, 359.3, 359.4, 380; 156/291, 277

(56) References Cited

U.S. PATENT DOCUMENTS

| | | | | |
|---|---|---|---|---|
| 2,055,693 | * | 9/1936 | Lewin | 215/277 |
| 3,272,422 | | 9/1966 | Miller . | |
| 3,547,746 | * | 12/1970 | Gwinner | 428/172 |
| 3,704,804 | | 12/1972 | Kaercher et al. . | |
| 4,214,029 | | 7/1980 | Barnes . | |
| 4,444,329 | * | 4/1984 | Vollers | 215/230 |
| 4,697,719 | | 10/1987 | Allen . | |
| 4,835,035 | * | 5/1989 | Bayer | 428/209 |
| 4,919,742 | | 4/1990 | Rebischung . | |
| 4,934,544 | | 6/1990 | Han et al. . | |
| 4,935,274 | | 6/1990 | DeBenedictis et al. . | |
| 4,960,216 | | 10/1990 | Giles et al. . | |
| 4,981,229 | | 1/1991 | Lanham . | |
| 5,004,111 | | 4/1991 | McCarthy . | |
| 5,197,618 | | 3/1993 | Goth . | |
| 5,226,281 | | 7/1993 | Han et al. . | |
| 5,294,470 | | 3/1994 | Ewan . | |
| 5,316,603 | * | 5/1994 | Akazawa et al. | 156/69 |
| 5,398,131 | * | 3/1995 | Hall et al. | 359/465 |
| 5,540,989 | | 7/1996 | Maul et al. . | |
| 5,637,396 | | 6/1997 | Sato et al. . | |
| 5,653,844 | * | 8/1997 | Abrams | 156/277 |
| 5,733,636 | | 3/1998 | May . | |
| 5,766,738 | | 6/1998 | Phillips et al. . | |
| 5,824,176 | | 10/1998 | Stein et al. . | |
| 5,858,490 | | 1/1999 | Mori et al. . | |
| 5,863,624 | | 1/1999 | Miyazaki et al. . | |
| 5,866,248 | | 2/1999 | Dressler . | |
| 6,056,141 | * | 5/2000 | Navarini et al. | 220/269 |
| 6,127,023 | * | 10/2000 | Marbler | 428/200 |

FOREIGN PATENT DOCUMENTS

| | | |
|---|---|---|
| 435 095 | 10/1967 | (CH) . |
| 673827 | 4/1990 | (CH) . |
| 1940970 | 2/1971 | (DE) . |
| 0034551 | 8/1981 | (EP) . |
| 0149180 | 7/1985 | (EP) . |
| 0 220 997 | 5/1987 | (EP) . |
| 0 292 386 | 11/1988 | (EP) . |
| 0 468 864 | 1/1992 | (EP) . |
| 0511562 | 11/1992 | (EP) . |
| 0847933 | 12/1996 | (EP) . |
| 2 294 838 | 7/1976 | (FR) . |
| 1 536 556 | 12/1978 | (GB) . |

* cited by examiner

*Primary Examiner*—Gene Mancene
*Assistant Examiner*—Joseph C. Merek
(74) *Attorney, Agent, or Firm*—Fisher, Christen & Sabol

(57) ABSTRACT

Lids (10) of a substrate material (5) having a plastic film, featuring printing (6) on the outside, with respect to a container (1) on which the lid (10) is employed, and an inward facing sealing layer (8,9), for closing the container (1) which has a shoulder region (4). The inward facing side of the substrate material (5) features the sealing layer (8,9) in the form of a printed image, and the printed image corresponds with the shoulder region (4) of the container (1) and is in the form of a series of points (12). The printed image (12) which forms the sealing layer (8,9) and the printed pattern (12) may be deposited in the same printing machine in which the printing (6) on the substrate layer takes place. The printed image (11) enables easy removal of the lids (10) individually from a stack of lids in the packaging machine without having to depend on embossing of the lids.

14 Claims, 3 Drawing Sheets

LID MATERIAL

BACKGROUND OF THE INVENTION

1. Field of the Invention

The invention relates to a non-embossed lid comprising a substrate material featuring printing on the outside, with respect to a container on which the lid is employed, and an inward facing sealing layer for closing the container which features a shoulder region, where the inward facing side of the lid features the sealing layer in the form of a printed image and the printed image corresponds with the shoulder region of the container.

2. Background Art

It is known to provide containers such as e.g. deep-drawn or stretch-drawn, or otherwise shaped containers with a flat ring-shaped shoulder and, in particular after filing, to lid such containers such that the lid lies over the whole shoulder area and is attached permanently and air-tight to it. Such beakers, dishes, menu-dishes e.g. featuring one or more compartments, goblets, small forms of packaging etc., are known for the purpose of packaging foodstuffs of all kind such as e.g. milk products, in particular yoghurt, whipping cream, sour milk, sour cream, coffee cream, ready-made salads or semi-preserved or fully preserved foodstuffs, pre-cooked or otherwise prepared meals, drinks such as fruit drinks and vegetable drinks, drinking water etc.

The lids are e.g. punched out of an endless strip of lid material and stacked. The stacks of lids are led to a packaging machine and the individual lids or lids from the stack successively sealed onto the already filled containers. The lids provided with a sealing layer are sealed onto the edge of the container at the shoulder region of the container using a sealing tool. The feeding of the lids or the removal the lids from the stacks is not always performed reliably by the packaging machines because the stacked lids may stick to each other. This sticking action may be prevented by embossing the lid material. The embossing, however, has a negative effect on the printed image on the outside of the lid.

Depending on the requirements, the lid material may be made of very different materials. Typical examples are metal foils coated on one or both sides with plastic. Other lid materials contain or are comprised of plastics in the form of monofilms or multi-layer laminates. Further lid materials may be made of cellulose-containing materials such as cellulose or paper. Also, laminates of metal foil and plastic films are employed. In order to seal the lid material to the edge of the container, a sealing layer such as a coating or sealing film is provided over the whole surface area of the lid material e.g. at east on the side facing inwards on the finished packaging i.e. Facing the interior of the container.

The lid material also serves as a substrate for information and advertising. For that reason the outside of the lid material is printed on. The printing may be on the outermost, outer facing layer on a finished container. The printing may also be covered over by a protective layer or film, or the outermost layer of the lid material may be of transparent material and bear the printing on the rear face in the form of a counterprint. The printed images may be single or multi-coloured images deposited in a printing machine.

The lid material is e.g. made in such a manner that a substrate such as a metal foil or laminate of plastic films made by bonding or calandering one or more other layers into a multi-layer laminate. The sealing layer is deposited on the side of the lid material facing inwards on the finished container, this by depositing a coating, or by laminate bonding the sealing layer onto it. After this, the lid material e.g. in coil form, is passed through a printing machine. It is possible therefore for the subsequently outward facing side of the lid material to be printed on. Also foreseen is an embossing step which provides the lid material e.g. with a worm-like embossed pattern.

Described in EP-A-0 847 933 is a lid material for containers where the sealing layer is deposited on the lid material in the form of a printed image and the printed image corresponds with the shoulder region of the container. The lid material is sealed along the shoulder region of the container by the sealing layer.

The disadvantage of older, known methods for manufacturing lid materials is the large expense for covering the whole surface area of the lid material with sealable material while only a small percentage of this sealable material is finally used to form the sealing seam. In the examples described the lid material has to be embossed and it is a disadvantage that the embossed lid material or the lid made therefrom does not reproduce the printed image properly.

BROAD DESCRIPTION OF THE INVENTION

The object of the present invention is to overcome this disadvantage and to propose a lid material which enables economic use of the individual materials and allows the lids to be drawn reliably from a stack of lids.

That objective is achieved by way of the invention in that the lid features on the inward and/or outward facing side a printed image with a large negative fraction and the printed image is from 2 to 20 $\mu$m thick.

The printed image is in particular outward lying i.e. it is always the outermost layer and is free on its outward face.

The printed image is usefully wholly or partly within the area delimited by the sealing layer.

DETAILED DESCRIPTION OF THE INVENTION

The printed image is preferably deposited on the inward facing side of the lid. Using the technology described in the following, the printed image may also be deposited outside or outside and inside. Printed images deposited on the outside influence the appearance of an already deposited image that is visible from the outside e.g. an advertisement. For that reason images printed on the outside are reserved mainly for special cases.

The substrate material may be a monofilm of plastic or a multilayer composite made up of two or more plastic layers or a metal foil or a metal foil or a multilayer composite of at least one metal foil or and at least one plastic film. The substrate material may also be of or contain cellulose-containing material. The cellulose-containing material may be coated on one or both sides e.g. with plastic, or metallised, or may feature a plastic layer on one side and a metallised layer on the other side. The plastics of the substrate material may be e.g. polyolefins such as polyethylenes or polypropylenes, polyamides, polyethylene-terephthalates or polyvinylchlorides. Steel or aluminium foils may be used as the metal foils. Papers or semi-cardboard, for example, may be used as celluslose-containing materials. Further substrate materials are e.g. cellophanes. The substrate material may be e.g. 12 to 500 $\mu$m thick, whereby the substrate materials of plastic films or of metal and plastic films are preferably 12 to 150 $\mu$m thick. The substrate materials are in particular sufficiently flexible to be rolled into coils.

Preferred support materials contain a transparent, opaque or non-diaphanous film or film composite having at least one plastic of polyesters, polyolefines such as polyethylenes or polypropylenes, polyamides or cellophanes or a metal foil coated with plastic or a layer-type material of paper with a layer of plastic such as e.g. a layer of polyethyleneterephthalate, which in turn may be metallised.

The support material may also exhibit a barrier layer against gases, vapours and moisture. Barrier layers may—apart from the above mentioned metal foils—be e.g. films of plastic such as polyvinylidenchloride or ethyl-vinyl-alcohol, or a layer of ceramic materials such as the oxides or nitrides of silicon or aluminium deposited as a thin layer e.g. 10 to 500 nanometre thick in a vacuum deposition process on a substrate. Examples of further barrier layers are metallic layers e.g. of aluminium deposited on the substrate by sputtering.

Printing may be provided on the side of the lid that is later the outer facing side of the container. The printing of the substrate material may be performed using all conventional printing methods e.g. typographic printing, offset printing, flexo-printing, screen printing, heliographic printing and copper-plate printing. The decision as to which printing method should be used depends on the desired quality of reproduction require, on the prevailing technical aspects and on the number of copies to be made. Preferred is flexo-printing (also known as aniline or offset printing) and intaglio printing such as copper-plate printing, or heliographic printing. The printing on the outer side of the support material may be covered by a protective coating or, using a laminating agent or adhesive, a transparent film e.g. of polyethylene-terephthalate, polyamide, polyolefins such as polyethylene or polypropylene or a layer of cellophane, which however is then generally applied in order to improve the protection of the counterprint image, may be deposited by laminate coating the substrate.

A sealing layer and a printed pattern are deposited on the side of the lid that faces the interior of the container. The sealing layer and the printed pattern are deposited on the substrate material in the form of printed images. The sealing layer may be deposited on the substrate material in a printing machine situated upstream or downstream in the process i.e. before or after creating the outer lying printed image. The printed image may be deposited on the substrate material in the same, or an upstream, or downstream printing machine i.e. at the same time as or before or after creating the sealing layer. Usefully, the printed image is deposited with the same printing form as that which prints the sealing layer. The printed pattern may, to advantage, comprise a primer and/or bonding agent and a sealing lacquer or only a sealing lacquer. It is preferred to use a primer or bonding agent and a sealing lacquer. The bonding agent or the primer and the sealing lacquer are deposited on the substrate material one after the other in a printing machine e.g. by typographic printing, offset printing, flexo-printing, screen printing, heliographic printing or copper-plate printing, preferably by flexo or intaglio printing. The printed pattern with a high negative fraction means that e.g. only 0.1 to 20%, usefully 1 to 10% of the inward facing area of the lid is covered with the printed pattern and the rest of the area is pattern-fee. The printed patterns may e.g. be comprised of uniformly or non-uniformly distributed rows of points, strips, strokes or lines. The thickness of the pattern is preferably 2 to 20 $\mu$m.

The sealing layer, and also the printed pattern, may contain or be of a sealing lacquer e.g. one of the polyolefins, preferably polyethylenes, or vinylacryl copolymers or acrylic polymer containing lacquers or epoxide lacquers. The sealing layer, and also the printed pattern, may contain also the sealing lacquer and a bonding agent or primer e.g. polyesters or vinyl-polymers. The bonding agent or primer is to advantage deposited on the substrate and the sealing lacquer on the bonding agent or primer.

Apart from the sealing lacquers one may also employ dispersions or lacquers—both lacquers containing solvents and solvent-free lacquers—such as polymer-containing lacquers e.g. based on PVC, PVC/PVAC, PVDC or acrylates to form the printed patter The solids content of the lacquers should be as high as possible and the fraction of solvent as low as possible. Logically, the dispersions and lacquers must be suitable for use on printing machines.

The present invention relates also to a process for manufacturing lids from a support material with, referring to a container on which the lids are used, outward facing printing and inward facing sealing layer such that the inward facing sealing layer is deposited on the substrate material using a printing process and the printed image corresponds to the shoulder region of the container, this for the purpose of closing off containers having an endless and in particular ring-shaped shoulder area.

The process is carried out in such a manner that a pattern with a high negative fraction of thickness 2 to 20 $\mu$m is printed on the inward and/or outward facing side of the lids. Preferred is printing a pattern on the inward facing side.

Preferred is a process for manufacturing lid material according to the present invention in which the inward facing sealing layer and the inward and/or outward facing, preferably inward facing printed pattern, and the outward facing printing—such as advertising or information etc.,—are deposited in a printing machine by double-sided printing on the lid material.

The present invention also relates to the use of lids from the substrate material having, with reference to the containers on which the lids are employed, outward facing printing and an award facing sealing layer and an inward facing printed pattern, such that the inward facing sealing layer is in the form of a printed image that corresponds to the shoulder region of the container, deposited on the lids and the printed image corresponds with the shoulder region of the container, and a printed pattern is deposited on the inward facing side of the lid, this for the purpose of closing off the container by sealing the lid to the corresponding shoulder region.

BRIEF DESCRIPTION OF THE DRAWINGS

FIG. 1 shows a schematic view of a beaker and a section through a lid according to the invention. FIGS. 2, 3 and 4 show plan views of on the inner side of the lids featuring various printed patterns.

DETAILED DESCRIPTION OF THE DRAWINGS

Figure 1:
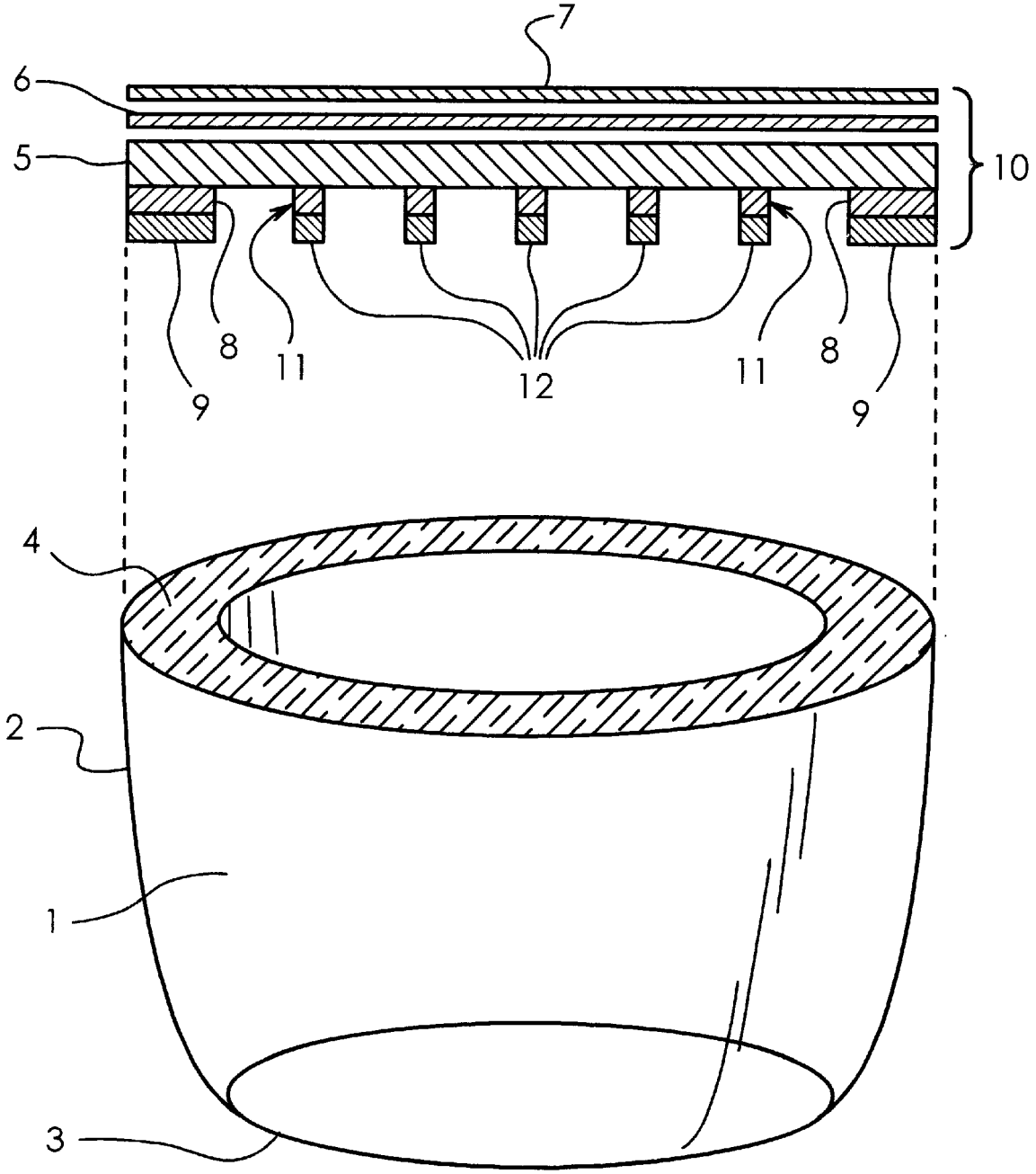
FIGS. 1 to 4 illustrate the invention in various forms.

FIG. 1 shows by way of example and schematically a beaker 1 with side wall 2, base 3 and upper edge which forms the shoulder 4. After filling the beaker 1 e.g. with a foodstuff or drink such as yoghurt, marmalade, dry fruit or chocolate preparation or another dessert or drinking water or fruit and vegetable juices, the beaker 1 is lidded with lid 10 and the lid 10 sealed to the beaker 1 along the shoulder 4. The lid 10 contains a substrate material 5, on top of that printing 6 and a protective layer 7, for example in the form of a protective lacquer or a protective foil. Deposited, only in places on the side of the substrate material 5, on the side facing the container or the interior of the container, in the region of the shoulder 4 of the container 1, is the sealing layer of primer 8 and sealing lacquer 9 i.e. on that area corresponding or approximately corresponding to the image of the ring-shaped shoulder 4 of the beaker 1. The sealing layer of primer 8 and sealing lacquer 9 has been deposited on the lid only or essentially only on those places on the substrate 5 that come into contact with the shoulder 4. This is indicated schematically by the broken lines. For the present example this would mean that the sealing layer 8,9 has been printed on the substrate 5 in the shape of a ring. It is obvious that the printed image of the sealing layer may vary slightly from the shoulder region 4 of the beaker 1. For example if the shoulder 4 is very broad, the printed image of the sealing layer 8,9 can be narrower e.g. 1 to 50% narrower than the breadth of the shoulder 4 of the container, or in order to compensate for the accuracy of the machines the area of the printed image of the sealing layer 8,9 can be selected to be some percentage e.g. 1 to 25% larger than the area of contact between the lid 10 and the shoulder region 4. The printed pattern 11 is for example formed by the primer 8 and the sealing lacquer 9. In the case of corrosion sensitive lid materials e.g. metal foils, it is recommended to deposit the primer 8 over the whole surface as a means of protection against aggressive contents.

Figure 2:
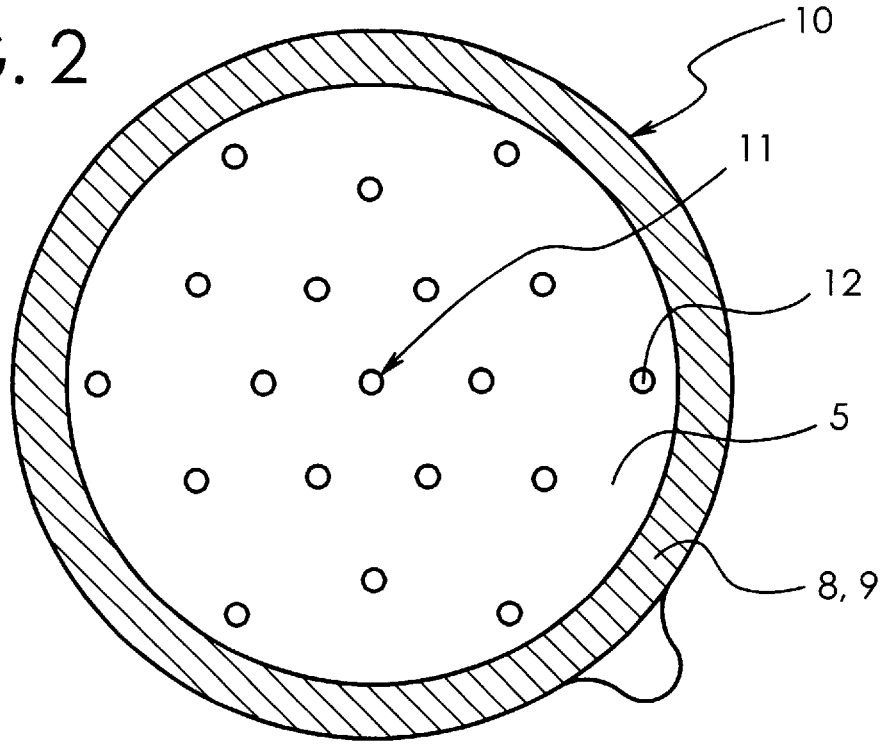
Figure 3:
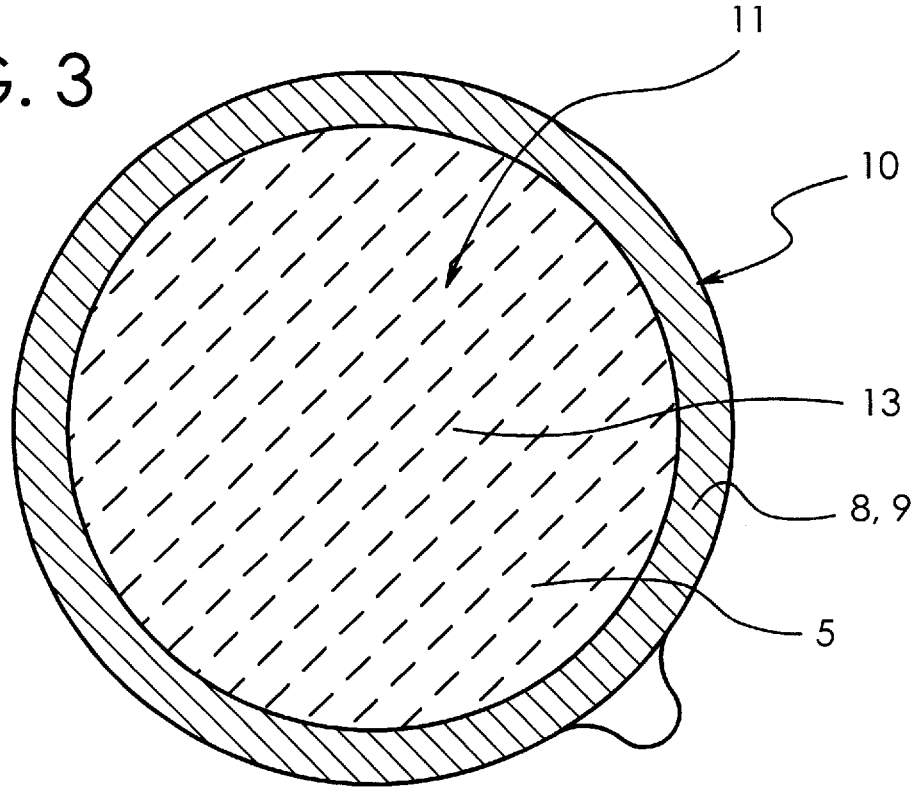
Figure 4:
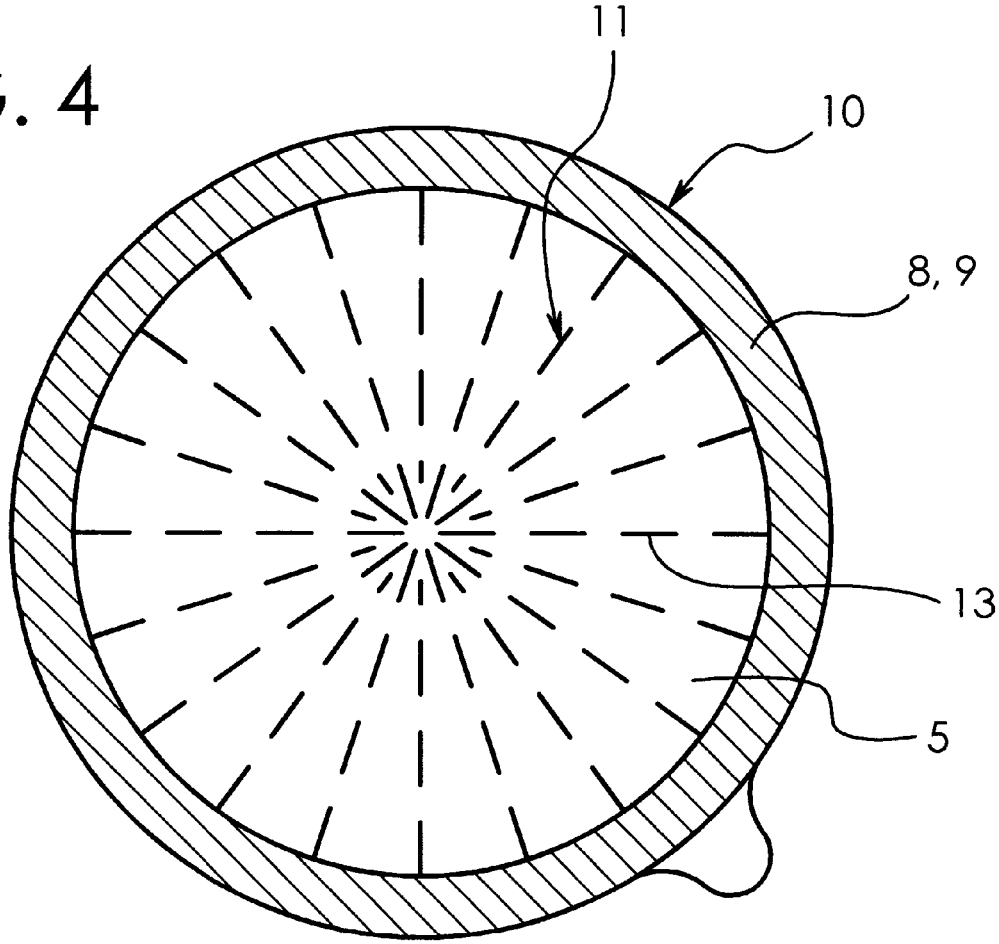

In FIGS. 2, 3 and 4 lids 10 are shown in plan view featuring different printed patterns 11. In FIG. 2 the printed pattern 11 can be seen in the form of a pattern made up of points 12. The pattern 11 is shown as a printed pattern lying within the printed sealing rim of sealing layer 8,9 on the substrate 5. In FIGS. 3 and 4 the printed pattern 11 is in the form of a series of individual streaks or stripes 13by way of example running parallel to each other or arranged radially. In this case the pattern 11 also lies printed on the substrate 5 within the printed sealing rim of sealing layer 8,9.

The lid material here may be sealed to the container rim by the sealing layer. The strength of the seal can be set by the choice of sealing tool, the sealing pressure and the sealing temperature. Aids to tearing may also be provided on the sealing seam e.g. in the form of less strongly sealed areas in the sealing seam or by jagged edges to the seam. Instead of the printed sealing seam it is also possible to make use of adhesive bonding using an adhesive such as a contact adhesive or one that bonds under the influence of heat and/or pressure, this provided the adhesive can be processed in a printing facility, and the adhesive can be printed on the lid material.

The present lid material has the advantage of being extremely economical in the use of starting materials, especially in that the primer or bonding agent and sealing lacquer are employed sparingly and only where these are actually needed. Typically, the primer or bonding agent is employed in amounts of 0.2 to 30 g, preferably 1 to 20 g per square metre, and the sealing lacquer in amounts of 0.5 to 30 g, preferably 1.5 to 20 g per square metre and in particular in each case 4 to 10 g per square metre. As the primer or bonding agent and the sealing lacquer normally have to be taken up by a solvent in order to be able to use them in a printing machine, the amount of solvent to be evaporated is considerably reduced. The present process according to the invention is therefore advantageous as the production of the lid material require one step less. The sealing layer does not have to be deposited separately as a layer or film, but instead can be deposited as the printed image is applied i.e. in the same process step and in the printing machine. The printed pattern separates the lids from each other when stacked and the lids are effectively prevented from sticking to each other. As a result the lids in stacks in the packaging machine are reliably fed to the process as required.

The finished lids nay also exhibit a tearing flap or grip and/or weaknesses e.g. in the form of perforations or notches which make it easier to open the container by removing the lid.

As the sealing layer on the lid is present essentially only in the region facing the shoulder of the container, there is reduced danger of components of the sealing layer diffusing into the contents of the container and e.g. influencing the contents with respect to smell and taste.

The present invention also enables completely or almost completely transparent lid materials to be manufactured in that the sealing lacquer is present only at places requiring sealing and not over the whole area of the lid and the properties of a completely transparent substrate material is fully retained. The transparency of the transparent substrate materials is not therefore impaired by the sealing lacquer and the primer.

What is claimed is:

1. A nonembossed lid (10) of a substrate material (5) where the substrate material is a foil or multilayer laminate, having, with respect to a container (1) on which the lid (10) is employed, printing (6) on the outside and an inward facing sealing layer (8, 9) for closing the container (1) which has a shoulder region (4), where the inward facing side of the substrate material (5) has the sealing layer (8, 9) in the form of a printed image and the printed image corresponds with the shoulder region (4) of the container (1), the lid (10) has on the inward and/or outward facing side a printed image (11) with a large negative fraction and the printed image (11) with a large negative fraction and the printed image (11) is from 2 to 20 $\mu$m thick where the printed image is for the purpose of separating lids from each other when stacked and allowing the lids to be drawn reliably from a stack of lids.

2. The lid according to claim 1; wherein the printed image (11) is wholly within area delimited by the sealing layer (8, 9).

3. The lid according to claim 1, wherein the printed image (11) is situated on the inward facing side, partly or wholly within area delimited by the sealing layer (8, 9).

4. The lid according to claim 1, wherein the printed image (11) contains a sealing lacquer or a bonding agent and/or a primer and a sealing layer or polymer-container lacquer.

5. The lid according to claim 4, wherein the printed image (11) contains a polyolefin, or a vinylacryl copolymer or an acrylic polymer-containing lacquer or an epoxide lacquer, or a bonding agent or primer of the polyester or vinyl-polymer type and a sealing lacquer containing a polyolefin, or a vinylacryl copolymer or an acrylic polymer-containing lacquer or an epoxide lacquer.

6. The lid according to claim 4, wherein the polyolefin in the printed image is polyethylene and the sealing lacquer contains a polyethylene.

7. The lid according to claim 4 wherein the substrate material contains a nonembossed thermoplastic or a nonembossed cellophane or a nonembossed cellulose-containing material or a nonembossed metal foil or a combination of these materials.

8. The lid according to claim 7, wherein the substrate material contains a combination of at least one thermoplastic and/or cellophane and/or a cellulose-containing material and/or a metal foil in the form of a multilayered, nonembossed composite material.

9. The lid according to claim 7, wherein the substrate material contains a barrier layer against gases, vapors and moisture, said barrier layer being a ceramic layer or a metallized layer or a plastic film or a metal foil.

10. The lid according to claim 1, wherein the printed pattern (11) covers from 0.1 to 20 percent of the inner facing surface of the lid.

11. The lid according to claim 10, wherein the printed pattern (11) covers from 1 to 10 percent of the inner facing surface of the lid.

12. The lid according to claim 1, wherein the thickness of the printed image (11) is from 2 to 20 $\mu$m.

13. The lid according to claim 1, wherein the printed image (11) is a series of uniformly or nonuniformly distributed points (12) or strokes (13) or lines.

14. The lid according to claim 1, wherein the printed image (11) is partially within area delimited by the sealing layer (8, 9).

* * * * *